United States Patent [19]

Keeley

[11] 4,193,495

[45] Mar. 18, 1980

[54] PORTABLE SPORTS EQUIPMENT ORGANIZER

[76] Inventor: Ronald Keeley, 6602 Hagerman St., Philadelphia, Pa. 19135

[21] Appl. No.: 940,074

[22] Filed: Sep. 6, 1978

[51] Int. Cl.[2] ..... B65D 85/00; A47F 7/00; A47F 5/08

[52] U.S. Cl. ..... 206/315 R; 211/13; 211/60 R; 224/45 R

[58] Field of Search ..... 206/315 R, 315 B; 211/60 R, 60 A, 13; 224/26 R, 45 R, 45 L; 248/316 D

[56] References Cited

U.S. PATENT DOCUMENTS

| | | | |
|---|---|---|---|
| 1,814,887 | 7/1931 | Bender | 224/26 F |
| 3,310,905 | 3/1967 | Davis et al. | 206/315 R |
| 3,343,684 | 9/1967 | Galier | 248/316 D |
| 3,698,563 | 10/1972 | Gordon et al. | 211/60 A |
| 4,049,126 | 9/1977 | Halverson | 211/60 R |

*Primary Examiner*—William T. Dixson, Jr.
*Attorney, Agent, or Firm*—Benasutti Associates, Ltd.

[57] ABSTRACT

An apparatus for supporting, transporting and storing equipment used in playing baseball, in an organized, convenient and readily accessible manner. The apparatus includes a support member upon which is mounted U-shaped clamps for removably holding at least one bat and L-shaped clamps for removably holding at least one batting helmet. The support member can be hung on a fence or backstop or other upright member whereby the equipment is stored in an organized and accessible manner during the game. In addition, the support member is foldable and provided with handles to enhance portability of the apparatus and the equipment mounted thereon.

17 Claims, 5 Drawing Figures

PORTABLE SPORTS EQUIPMENT ORGANIZER

BACKGROUND OF THE INVENTION

The present invention generally relates to sports equipment and more particularly to apparatus for transporting, storing, organizing and providing easy accessibility to equipment used in playing baseball or softball or the like. Certain equipment is fundamental to the games of baseball and softball. Essential of course is a ball and a bat. As participation in these sports becomes more organized, the amount of equipment required becomes more extensive. For example, in addition to the requisite ball and bat, safety dictates that a batter should wear a batting helmet and a catcher should wear a helmet, mask, chest protector, and shin guards. It is practically standard now, in organized leagues, that each team have at least one complete catchers outfit including a catchers mitt as well as a number of batting helmets, bats and balls.

In the past, it has been customary to store all this equipment in a duffle bag. As result, all the equipment is gathered at the end of the game and randomly thrown into the duffle bag.

Prior to the beginning of each game, the duggle bag is normally turned unside down the contents thereof strewn on the ground. This method of storage is generally abusive to the equipment, tending to reduce the useful life thereof.

During the course of the game, this equipment has, in the past, been haphazardly strewn about the bench or dugout area creating a disorganized and potentially hazardous situation. The bats, balls and equipment lying around can trip the unwary individual, someone may be struck by a carelessly thrown bat and, it becomes very difficult to keep track of equipment which is randomly scattered about. In addition, it becomes time consuming when a batter has to rummage around for his favorite bat.

Summary of the Invention

The present invention provides a means for transporting and storing baseball or softball type equipment is an organized and easily accessible fashion. These accomplishments result from the numerous features incorporated in applicant's novel apparatus.

One such feature is a novel means for removably attaching bats in an orderly fashion to a support member. These bats are held in place in a vertical orientation by U-shaped clamps. Another feature is a novel means for removably attaching batting helmets to the support member, comprising opposed L-shaped clamping members having hemispherical projections on the inwardly disposed surface thereof for engaging the ear holes of the helmet. Another such feature is a U-shaped clamp adapted for clamping or supporting balls on the support member.

Yet another feature is support means disposed on the top edge of the support member for supporting the support member and the associated equipment being held thereon, on a wall or fence or other type of partition or enclosure, for example a baseball field backstop. Still another feature is carrying means disposed on the top edge of the support member for carrying it and the equipment being held thereon from place to place. A further feature is a hinge means disposed in the center of the support member which enables the support member to be folded into a configuration in which the sports equipment is mounted on the outwardly disposed surfaces of the support member and the portability of the apparatus is enhanced. A further feature, whereby the bats are held with the lower portion thereof extending beneath of bottom edge of the support member, enables the support member to be self-supporting on the ground or other supporting surface, utilizing the stored bats as supporting legs.

Accordingly, a primary object of the present invention is the provision of a novel apparatus for transporting, storing and providing accessibility to equipment used in baseball or softball or the like.

Another object of the present invention is the provision of an apparatus, the use of which enables the transporting of the sports equipment in an orderly and efficient manner.

A further object of the present invention is the provision of an apparatus for storing the equipment in an easily accessible manner while the game is being played.

An additional object of the present invention is the provision of an apparatus, the use of which enables the user to keep track of equipment before, during and after the game.

These and other objects of the present invention will become apparent from the following more detailed description.

DETAILED DESCRIPTION OF THE DRAWING

Figure 1:
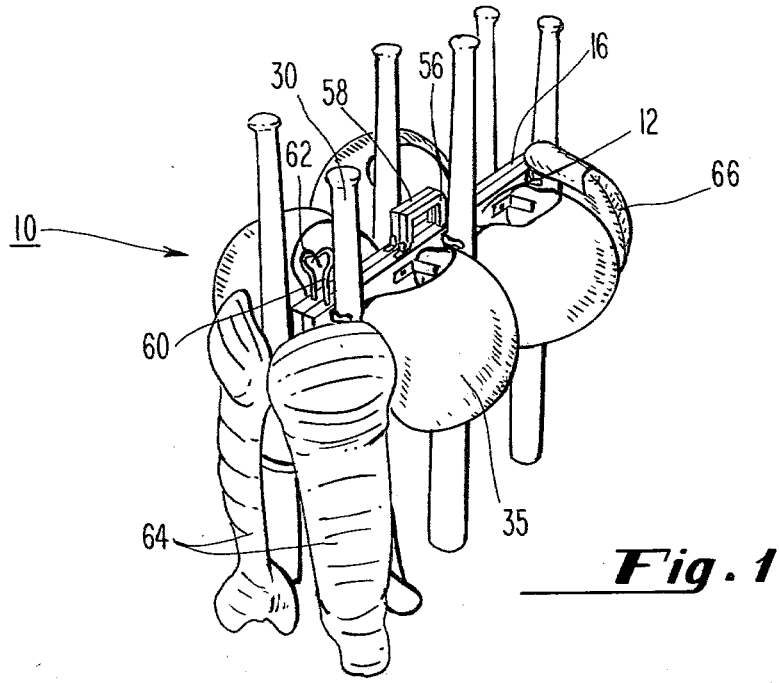
FIG. 1 is a perspective view of the preferred embodiment of a portable sports equipment organizer of the present invention, showing the apparatus in a folded condition with bats, helmets, shin guards, and a catchers mitt shown stored thereon.

Although specific terms of the invention have been selected for illustration in the drawings and the following description is drawn in specific terms for the purpose of describing these forms of the invention, this description is not intended to limit the scope of the invention which is defined in the appended claims.

Figure 2:
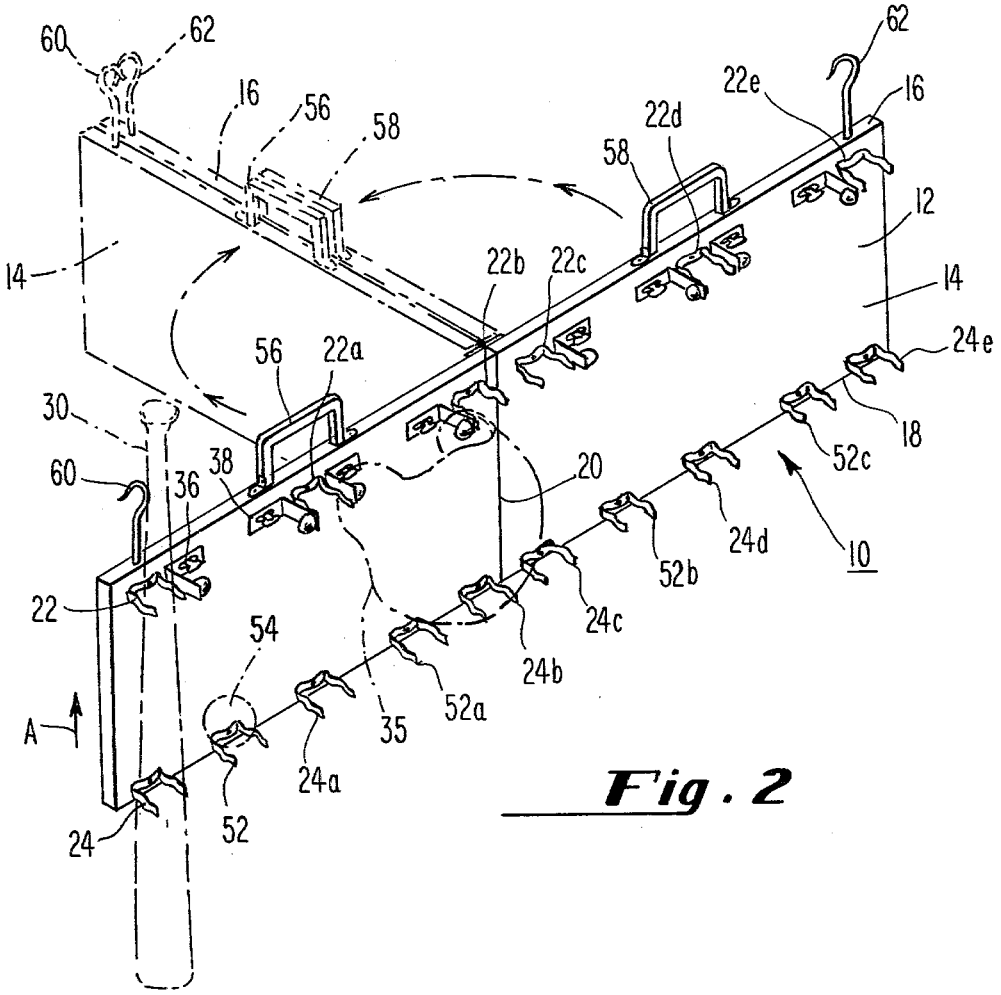
FIG. 2 is a perspective view of the apparatus of the present invention showing the apparatus in an unfolded position with a mounted bat and batting helmet shown in phantom as well as a phantom view of the apparatus in a folded configuration.

Referring to FIG. 2, there is shown a preferred embodiment of the sports equipment organizer of the present invention generally designated 10. The organizer 10 comprises a support member 12. The support member 12 is preferably rectangularly shaped having a front surface 14 with a top edge 16 and a bottom edge 18. In the preferred embodiment, the support member 12 is a mounting platform as shown in FIG. 2. The mounting platform is preferably contructed of a substantially rigid, lightweight sheet of material such as plywood or aluminum sheet stock, with or without a supporting framework, depending upon the rigidity of the sheet material used, the support member to be rigid enough to support equipment as hereinafter described. Alternatively, the support member 12 could also comprise a supporting frame without the sheet material, with the other components hereinafter described being mounted directly on such frame. This and other alternate embodiments of the support member are deemed to be within the scope of the invention defined herein. The support member 12 is preferably hinged at its center, designated by reference numeral 20, thereby allowing the support member 12 to be folded as shown in FIG. 1 and in phantom in FIG. 2. In the folded configuration, each half of the front surface 14 faces in an outward direction.

Means for removably attaching bats to the support member 12 are disposed on the front surface 14. In the preferred embodiment, this means comprises a pair of U-shaped clamps 22 and 24 mounted on the front surface 14 of the support member 12. A first U-shaped clamp 22 is mounted near the top edge 16 of the support member 12. A second U-shaped clamp 24 is mounted near the bottom edge 18 of the support member 12 in substantially vertical alignment with the first U-shaped clamp 22.

Figure 3:
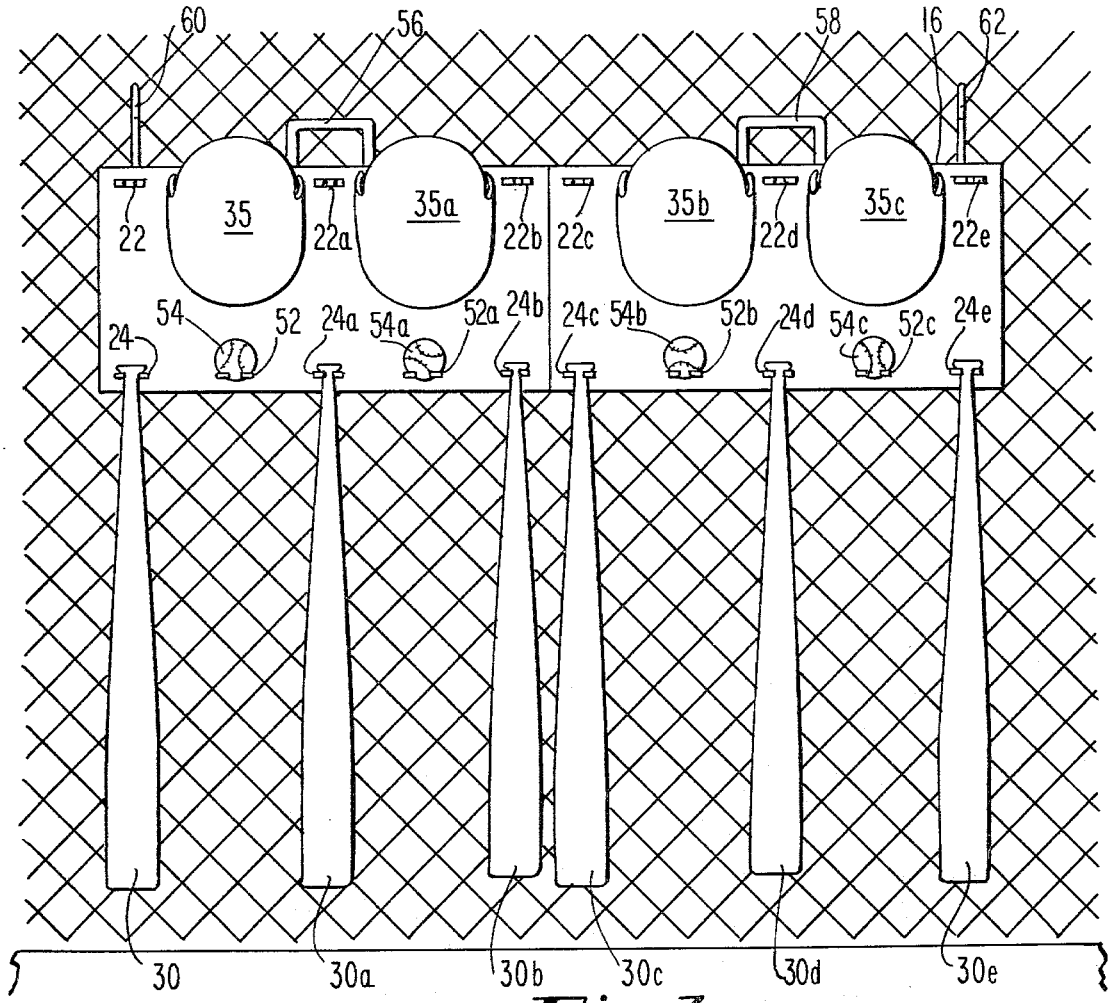
FIG. 3 is a elevational view of the apparatus of the present invention shown hanging from a mesh type fence and having batting helmets, bats and balls mounted thereon.
Figure 4:
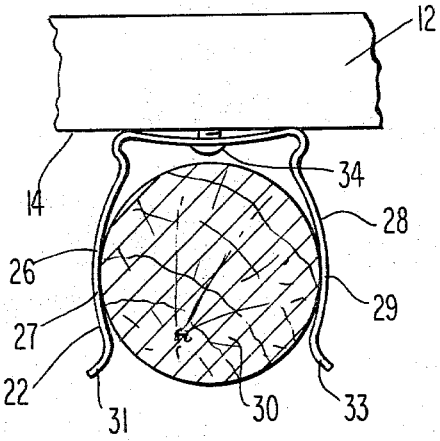
FIG. 4 is a greatly enlarged view of a bat holding clamp of the present invention.

In FIG. 4, there is shown an enlarged top view of a typical U-shaped clamp, for example the first clamp 22. The first 22 and second 24 U-shaped clamps are similar therefore the following description of a typical U-shaped clamp applies to both. The U-shaped clamp 22 comprises first and second outwardly extending legs 26 and 28 respectively. Each leg has a curved portion, 27 and 29 respectively, for embracing a bat 30 disposed therebetween. In addition, the outward end 31 and 33 of each leg 26 and 28 respectively is preferably curved away from the opposing leg to facilitate insertion of bats therebetween. The clamp is made of a resilient material, for example spring steel, with the legs 26 and 28 being biased towards each other. Insertion of the bat 30 into the clamp will cause the legs 26 and 28 to spread outwardly with the inward bias being of sufficient magnitude to cause the bat to be retained within the curved portions 27 and 29 of the legs. In addition, the clamps are sized such that, taking into account the tapered shape of the usual baseball or softball bat, a bat shown in phantom position 32 in FIG. 2 will be restrained from moving upwardly through the clamps in the general direction indicated by the arrow A. The importance of this feature will be explained subsequently. The clamps are attached to the support member 12 by a screw of bolt 34 or other suitable attachment means. Pairs of these bat holding U-shaped clamps, designated 22*a*, 24*a*; 22*b*, 24*b*; 22*c*, 24*c*; 22*d*, 24*d*; and 22*e*, 24*e* are disposed at predetermined intervals along the front surface 14 of the support member 12, as shown in FIGS. 2 and 3. Note that the accompanying figures show six pairs of U-shaped clamps for holidng six bats. This number is shown by way of example only and a greater or lesser number is deemed to fall within the scope of the invention defined herein.

Figure 5:
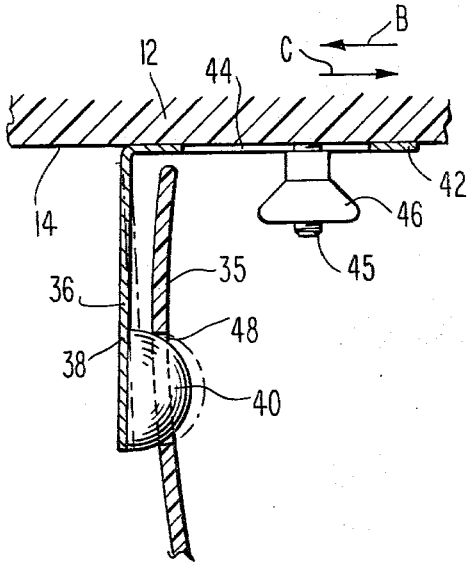
FIG. 5 is a greatly enlarged view of an adjustable L-shaped batting helmet holding clamp of the present invention.

As shown in FIG. 2, means for removably attaching a batting helmet 35 to the support member 12 is disposed between adjacent ones of the first U-shaped clamps 22. The helmet attaching means comprises, in the preferred embodiment, a pair of opposed L-shaped clamps 36 and 38. Referring to FIG. 5, there is shown a greatly enlarged view of a first L-shaped clamp 36. The opposing second L-shaped clamp 38 is a mirror image of the first L-shaped clamp and includes corresponding parts; consequently, the description of the first L-shaped clamp 36 is applicable to the second L-shaped clamp 38. The L-shaped clamp 36 comprises an outwardly extending leg 38 having an inwardly disposed helmet engaging projection 40 at the end thereof. In the the preferred embodiment, this projection is hemispherical in shape. The L-shaped clamp 36 also has a base leg 42 having an elongated aperture 44 therein whereby the L-shaped clamp 36 is adjustably mounted, along the directions indicated by the arrows B and C, to the front surface 14 of the support member 12 using a bolt 45 and a wing nut 46 arrangement, for example. The adjustable mounting arrangement permits the opposed L-shaped clamps 36 and 38 to accomodate helmets of various sizes.

The projection 40 engages an ear hole 48 in the batting helmet 35. The L-shaped clamp 36 is made of a resilient material, such as spring steel. The outwardly extending leg 38 is inwardly biased in the direction indicated by the arrow C toward the position indicated by the broken lines in FIG. 5. Insertion of the batting helmet 35 will cause the leg 38 to move in the direction indicated by the arrow B until the projection 40 engages the aperture or ear hole 48 whereupon the inward biasing will cause the leg 38 to retain the projection 40 in the ear hole 48. The L-shaped clamp 38 operates in a similar manner whereby the helmet engaging projection 40 of each will engage respective opposing ear holes thereby retaining the helmet 35 in position with respect to the support member 12. As previously stated, the helmet engaging projection 40 is preferably hemispherical; however, it could also be a semicircle or any other shape which facilitates the insertion of a helmet between the opposed clamps and which subsequently engages apertures or ear holes therein. Pairs of the L-shaped helmet holding clamps 36*a*, 38*a*; 36*b*, 38*b*; and 36*c*, 38*c* are preferably disposed between adjacent ones of the first U-shaped bat holding clamps 22. Note that the accompanying figures show four pairs of L-shaped clamps for holding four helmets. This number is shown by way of example only and a greater or lesser number is deemed to fall within the scope of the invention defined herein.

Also disposed on the front surface 14 of the support member 12, preferably adjacent the lower edge 18 between adjacent ones of the second U-shaped bat holding clamps 24 as shown in FIGS. 2 and 3, are U-shaped clamps 52 adapted to hold or support a ball 54. As shown in FIG. 2, the U-shaped clamp 52 which supports the ball 54 is preferably a U-shaped bat holding clamp whereby the ball 52 rests on the top edges thereof. The use of bat holding clamps to support the balls reduces the number of different parts required thereby reducing the cost. In addition, additional bats, instead of balls, can be supported by these clamps if necessary. The clamp 52 is attached to the mounting board 12 in a manner similar to the attachment described with respect to the first 22 and second 24 bat holding clamps and as shown in FIG. 4. Alternatively, the ball holding U-shaped clamp 52 could be a clamp specially adapted to clamp and embrace the ball 54 by providing a clamp having concave depressions in the outwardly extending legs thereof. These despressions would engage portions of the opposed surfaces of the ball and retain the ball within the embrace of the clamp.

As shown in FIGS. 1, 2 and 3, a pair of handles 56 and 58 are attached to the top edge of the support member 12 in order that a user may conveniently grasp and carry the organizer 10 with or without the sports equipment stored thereon. The handles are preferably positioned with respect to each other such that they meet when the mounting board 12 is folded as shown in FIG. 1.

Also attached to the top edge 16 of the support member 12 are means to support the opened organizer 10 from a wall, partition, fencing means or other upright element such as a backstop of a baseball diamond. In the preferred embodiment, the supporting means comprises a pair of hooks 60 and 62 attached to the top edge 16 at each end of the support member 12. Referring now to FIG. 3, the organizer 10 is shown hung from a mesh type vertical enclosure, for example a backstop or a chain link fence, by means of the hooks 60 and 62. As depicted in FIG. 3, the organizer 10 provides an orderly, convenient, and safe means of storing the equipment in a convenient location during the game. The bats 30, balls 54 and batting helmets 35 have their respective positions on the organizer. In addition, when the bats are stored as shown in FIG. 3, hanging from the second U-shaped bat holding clamps 24, the first U-shaped bat holding clamps 22 can be used to hang catching gear, gloves, as well as to support additional balls.

Referring to FIG. 1, there is shown the sports equipment organizer 10 of the present invention in its folded configuration having bats 30, helmets 35, and catching gear, such as shin guards 64 and catcher's mitt 66 stored thereon. As depicted in FIG. 1, the bottom portion of the bats 30 extend beyond the bottom edge of the folded support member 12. Since, as previously described, the bats are securely held in the vertical position and restrained from moving upwardly through the clamps, the bats can serve as legs for supporting the organizer 10 and the equipment stored thereon, on the ground or other supporting surface. This feature permits the organizer 10 to be self supporting prior to being loaded into a vehicle, or in a storage area between games or in other temporary or long term storage situations.

As indicated by the preceding description, the sports equipment organizer of the present invention provides a novel and convenient means for transporting, storing, displaying, supporting and otherwise handling baseball or softball type equipment in an organized and easily accessible fashion. It can be conveniently supported during play by a backstop, fence or other types of partitions or enclosures commonly found at baseball or softball or similar recreational areas. While being so supported, the organizer facilitates orderly storage of the playing equipment thereby minimizing, if not totally eliminating, the random, and often hazardous scattering of the equipment around the area. In addition, using the stored bat as legs, the organizer is conveniently self supporting. Note also that, as shown in FIG. 1, the handles of mounted bats can also serve as posts over which equipment, such as the shin guards and catchers mitt shown as well as chest protectors, catchers masks etc., not shown, can be hung.

It will be understood that various changes in the details, materials and arrangements of parts which have been herein described and illustrated in order to explain the nature of this invention may be made by those skilled in the art within the principle and scope of the invention as expressed in the following claims.

What is claimed is:

1. An apparatus for supporting, transporting and storing equipment used in baseball, softball, or similar games, said apparatus comprising:

a. a support member;

b. means for removably attaching at least one bat to said support member; and c. means for removably attaching at least one helmet to said support member.

2. The invention of claim 1 wherein said support member is substantially rectangularly shaped, having a front surface with a top edge and a bottom edge.

3. The invention of claim 2 wherein said means for removably attaching a bat comprises at least one substantially U-shaped clamp disposed on the front surface of said support member, said U-shaped clamp having a pair of legs outwardly extending from said front surface and resiliently biased toward each other for embracing at least a portion of said bat.

4. The invention of claim 3 wherein said means for removably attaching a bat comprises two of said U-shaped clamps disposed on said front surface, a first clamp being disposed adjacent said top edge and a second clamp being disposed adjacent said bottom edge in substantial vertical alignment with said first clamp.

5. The invention of claim 3 wherein each leg includes a curved portion curving away from the other leg whereby said bat is retained between said curved portions of said legs.

6. The invention of claim 2 wherein said means for removably attaching a helmet comprises at least one pair of opposed L-shaped clamps disposed on the front surface of said support member, each clamp having a leg outwardly extending from said front surface which is resiliently biased toward the opposing clamp, said leg having a projection extending toward the opposing clamp for engaging an aperture in said helmet.

7. The invention of claim 6 wherein said opposing L-shaped clamps are adjustably mounted with respect to each other on said front surface.

8. The invention of claim 6 wherein said projection is hemispherical in shape.

9. The invention of claim 2 wherein said apparauts additionally comprises means for removably supporting at least one ball on said support member.

10. The invention of claim 9 wherein said means for removably supporting a ball comprises a substantially U-shaped support disposed on the front surface of said support member, said U-shaped support having a pair of legs outwardly extending from said front surface, each leg having a curved portion curving away from the other leg whereby by said ball is supported upon said U-shaped support within said curved portions of said legs.

11. The invention of claim 9 wherein said means for removably supporting a ball comprises a substantially U-shaped clamp disposed on the front surface of said support member, said U-shaped clamp having a pair of legs outwardly extending from said front surface and resiliently biased toward each other and having concave despressions in facing surfaces thereof for embracing and retaining a ball therebetween.

12. The invention of claim 2 wherein said apparatus additionally comprises means for removably attaching said apparatus to an upright member.

13. The invention of claim 12 wherein said means for removably attaching said apparatus comprises at least two hooks attached to said top edge of said support member.

14. The invention of claim 2 wherein said apparatus additionally comprises handle means for carrying said apparatus.

15. The invention of claim 14 wherein said apparatus additionally includes hinging means for folding said support member into at least two sections whereby said front surface thereof is outwardly disposed when said support member is in a folded condition.

16. The invention of claim 15 wherein said hinge means is disposed at the center of said support member, substantially perpendicular to said top and bottom edges, whereby said support member is foldable in half.

17. The invention of claim 16 wherein said handle means comprises two handles attached to the top edge of said support member, a first handle located substantially midway between one end of said support member and said hinge means and a second handle located substantially midway between the hinge means and the other end of said support member whereby said handles are disposed adjacent one another when said support member is in said folded condition.

* * * * *